United States Patent [19]

Pepe

[11] Patent Number: 4,664,325

[45] Date of Patent: May 12, 1987

[54] GUARD FOR POWER DRIVEN SPOOL WINDER

[75] Inventor: David Pepe, Meriden, Conn.

[73] Assignee: Sterling Davis Electric, Wallingford, Conn.

[21] Appl. No.: 811,221

[22] Filed: Dec. 20, 1985

[51] Int. Cl.[4] ..... B65H 54/20; B65H 67/052

[52] U.S. Cl. ..... 242/25 A; 242/35.5 R

[58] Field of Search ..... 242/25 A, 25 R, 18 A, 242/18 R, 35.5 R; 57/1 R, 354, 356

[56] References Cited

U.S. PATENT DOCUMENTS

| | | | |
|---|---|---|---|
| 2,971,710 | 2/1961 | Bunch | 242/25 A |
| 3,146,572 | 9/1964 | Keyser | 57/1 R |
| 3,606,751 | 9/1971 | Weller et al. | 57/356 X |
| 3,782,087 | 1/1974 | Franzen et al. | 57/1 R |
| 3,837,589 | 9/1974 | Johnson et al. | 242/25 A |
| 3,918,650 | 11/1975 | Kemel | 242/25 R |
| 3,977,169 | 8/1976 | Suzuki et al. | 57/1 R |
| 4,347,989 | 9/1982 | Pieper et al. | 242/35.5 R |
| 4,516,396 | 5/1985 | Stahlecker et al. | 57/1 R X |
| 4,570,743 | 2/1986 | Wetter | 242/35.5 R X |

*Primary Examiner*—Stanley N. Gilreath

*Attorney, Agent, or Firm*—Pennie & Edmonds

[57] ABSTRACT

Protection guard doors are provided on a power driven spool or reel winding machine. The guard doors are pivotally supported so that when either one is opened to remove a spool or reel from the take-ups, the opened door pivots between the two reels to act as a guard to protect the operator from accidentally coming into contact with the moving parts of the second reel.

4 Claims, 2 Drawing Figures

GUARD FOR POWER DRIVEN SPOOL WINDER

FIELD OF INVENTION

This invention relates generally to power driven spool and/or reel winding machines and more particularly to an operative guard means for protecting the operator of the machine from physical injury during the loading and unloading of spools and/or reels to and from the power driven machine.

SUMMARY OF PRIOR ART

Provision of some degree of protection of the operator of power driven spool winding machines is known in the prior art. Plate guards have been provided that move sideways to protect the operator from falling into the machine and getting caught by the wire or reel. When an operator must remove a full reel and replace it with an empty one, quite frequently he must reach inside the enclosure and remove the snagged wire from the snagger hook. This means reaching into the machine with a reel running adjacent the operator's hand. Even if it were unnecessary to reach the inside flange, the operator must usually rotate the reel or pull it off the shaft by grabbing the outside reel flange. This is all very close to the running reel and accordingly fraught with danger.

Plate guards have been installed between the reels which move into position when the full reel stops and the empty reel is taking up wire. The plate guard protects an operator from accidentally touching the running reel and it provides operator protection in cases of wire breakage.

SUMMARY OF THE INVENTION

In accordance with the present invention, swinging front doors are provided for the two arbor supported reels which provide frontal protection against operator injury from the two reels. The doors are pivotally supported so that when either one is opened to remove a spool or reel from the take-up, the door pivots between the two reels to act as a guard to protect the operator. The door that is swung to open position acts as a protective wall between the two reels thereby segregating the two halves of the machine and preventing the operator from accidentally coming into contact with the moving parts of the second reel.

The swing door guard provided by the invention has a dual purpose of changing from a position perpendicular to the arbor shaft to one that is parallel to the arbor shaft where it is then a guard to protect the operator from the running reel while down-loading the full reel.

BRIEF DESCRIPTION OF DRAWINGS

Referring to FIG. 1, there is shown a spooler 10 which automatically spools a predetermined amount of flexible stock material 11 (e.g. wire) onto reels 12 and 13 via pulleys 14, 15 and 16. The overall operation of a spooling machine is given in further detail in U.S. Pat. No. 3,837,589 the teachings of which are incorporated herein by reference.

Figure 1:
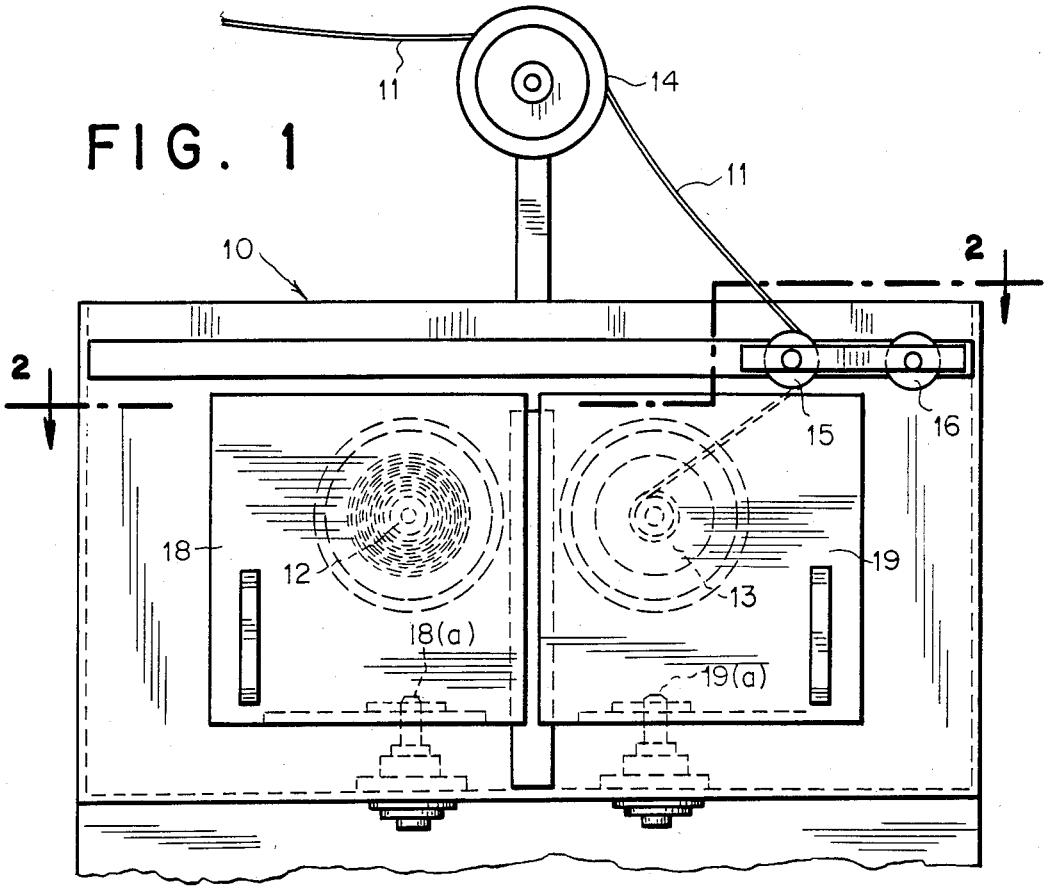
FIG. 1 is a simplified front view drawing of an automatic spooler with the front doors shown in closed position.
Figure 2:
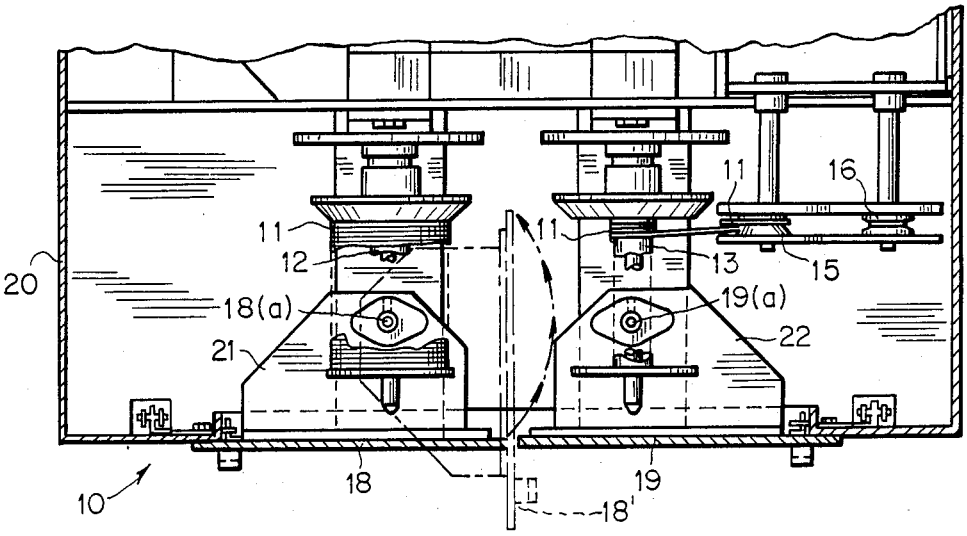
FIG. 2 is a partial plane view of the spooler of FIG. 1 showing the left-hand door in fully opened position.

Access to either of the spools 12 or 13 is provided by swinging front doors 18 and 19 respectively. These doors cover an opening in the front of the housing 20 in which the reels are mounted. Each door has a flange 21, 22 extending inwardly of the housing. When access to a reel or spool is required, the front door for that spool is pivoted 90° and brought to rest as shown in FIG. 2. It will be appreciated by those skilled in the art that door 18 as shown provides frontal protection for the operator when closed and protection from spool 13 when in the open position 18'.

Advantageously doors 18 and 19 are constructed so that only one of the two doors may be pivotally opened at any one time and rotated to the guard position 18' as shown in FIG. 2.

When spool 12 is full, door 18 is pivoted to the open position 18' on pivot support 18 (*a*) on which the flange 21 of door 18 is mounted. In like manner, door 19 is pivotally supported by hinge 19 (*a*) by the attachment to the flange 22 of the door 19 so that door may be rotated 90° to its open position to permit operator access to spool 13.

Although an illustrative embodiment has been shown and described, it is to be understood that various modifications and substitutions may be made by those skilled in the art without departing from the spirit and scope of the present invention.

I claim:

1. A protective door guard structure for a take-up apparatus having alternately driven, dual, parallel shafts; a take-up reel mounted on each of said shafts in open proximity to each other and a housing enclosing the take-up apparatus with an opening in the front of the housing providing access to each of said reels for removal and replacement thereof; said door guard structure comprising:

(a) a separate door guard for each take-up reel positioned at the front of the housing; and (b) means for pivotally mounting each door guard for movement between a first closed position covering the portion of the opening in the housing in front of its respective reel and a second opened position extending from the other door in the closed position and between said reels.

2. A protective door guard structure according to claim 1 wherein:

(a) each door guard is positioned in a plane extending perpendicular to the arbor shafts when in the closed position and parallel to and between the arbor shafts when in the opened position to permit the reels on the arbor shafts to be removed from the housing by axial movement along the shafts.

3. A protective door guard structure according to claim 2 wherein:

(a) each door guard includes a flange extending from the door guard and into the interior of the housing; and (b) the means for pivotally mounting the door guard includes a pivot on which the flange is mounted interiorly of said housing.

4. The protective door guard structure according to claim 3 wherein:

(a) the two door guards when in their closed positions completely cover the opening in the housing.

* * * * *